United States Patent [19]

Dorsey, Jr.

[11] 4,101,346

[45] Jul. 18, 1978

[54] PROTECTIVE HYDROPHOBIC AND OLEOPHILIC COATING FOR ALUMINUM PRODUCTS

[75] Inventor: Geoffrey A. Dorsey, Jr., Danville, Calif.

[73] Assignee: Kaiser Aluminum & Chemical Corporation, Oakland, Calif.

[21] Appl. No.: 709,026

[22] Filed: Jul. 27, 1976

Related U.S. Application Data

[63] Continuation-in-part of Ser. No. 610,966, Sep. 8, 1975, Pat. No. 4,004,951, which is a continuation-in-part of Ser. No. 593,092, Jul. 3, 1975, abandoned.

[51] Int. Cl.[2] ..... C23F 7/00

[52] U.S. Cl. ..... 148/6.27; 427/292; 427/327; 72/46; 72/42; 252/32

[58] Field of Search ..... 148/6.27; 427/327, 292; 72/46, 42; 252/18, 17, 32

[56] References Cited

U.S. PATENT DOCUMENTS

| | | | |
|---|---|---|---|
| 2,107,288 | 2/1938 | Curran | 87/5 |
| 2,230,273 | 2/1941 | Smith | 148/6.14 X |
| 2,599,353 | 6/1952 | Showalter | 252/21 |
| 2,739,915 | 3/1956 | Schuster et al. | 148/6.15 R X |
| 2,963,391 | 12/1960 | Kubie | 148/6.14 |
| 3,228,866 | 1/1966 | Pryor | 204/197 |
| 3,781,177 | 12/1973 | Kondis | 427/216 |
| 3,849,207 | 11/1974 | Marossi | 148/6.27 |
| 3,911,704 | 10/1975 | Bridenbaugh et al. | 72/42 |
| 3,923,671 | 12/1975 | Knepp | 72/42 X |

*Primary Examiner*—Ralph S. Kendall

*Attorney, Agent, or Firm*—Paul E. Calrow; Edward J. Lynch

[57] ABSTRACT

This invention is directed to a process for forming a hydrophobic and highly oleophilic coating on an aluminum surface which comprises treating the aluminum surface under aqueous alkaline conditions with a long chain aliphatic carboxylic acid (or an equivalent carboxylate compound), such as isostearic acid, which has one or more short secondary alkyl groups on or near the nonpolar end of the carboxylate compound. The coating can be formed by treating the surface with an aqueous alkaline solution which contains the carboxylic acid or the coating can be formed by mechanically deforming or upsetting the aluminum surface to expose a fresh aluminum surface to a carboxylic acid (or its equivalent) and a compound which generates alkaline conditions on the aluminum surface. In the latter instance, the carboxylic acid and alkaline compound is preferably incorporated into a metal-working lubricant used to facilitate deformation.

19 Claims, No Drawings

PROTECTIVE HYDROPHOBIC AND OLEOPHILIC COATING FOR ALUMINUM PRODUCTS

RELATED Applications

The application is a continuation-in-part of application Ser. No. 610,966 filed Sept. 8, 1975 now U.S. Pat. No. 4,004,951, which is a continuation-in-part of application Ser. No. 593,092 filed July 3, 1975, now abandoned.

BACKGROUND OF THE INVENTION

This invention is directed to a simple method of forming a hydrophobic, highly oleophilic coating on an aluminum surface which prevents excessive oxidation of the surface and which is very compatible with and readily wet by oily liquids such as metal-working lubrications.

Many processes are presently available for forming protective coatings on aluminum surface, such as anodizing, plating, chemical conversion coating, painting and the like. The resultant coatings, although designed for long life, require extensive surface pretreatments and are quite expensive. However, frequently, only short-term protection is needed or desired, for example, to prevent the formation of water stain or other oxidation products in the shipping or storing of semifabricated aluminum products, such as coiled sheet and the like. The application of various types of oils to continuous sheet prior to coiling has usually been found to be inadequate to effectively prevent water stain. In some instances, it is desirable to prevent the gradual buildup of natural oxide on the aluminum surface, for example, in welding applications and adhesive bonding applications because the buildup of natural oxide can interfere with these processes.

However, no simple and inexpensive process is presently known which will form a protective coating without interfering with subsequent fabrication, particularly when lubricants are applied to the surface, and without detrimentally affecting the surface appearance of the fabricated product.

A simple, inexpensive process for coating aluminum is described by Wittrock et al in U.S. Pat. No. 3,726,721, assigned to the present assignee, but the friable coating formed by this process can interfere with the surface appearance after forming or coating operations.

Kubie in U.S Pat. No. 2,963,391 describes a process for forming a coating designed as an extrusion lubricant wherein the aluminum surface is first treated with an ammonia-laden alkaline solution containing a fatty acid (or equivalent salt or ester thereof) and then baked at about 400° F to form a coating having unknown properties except for lubrication.

Marosi in U.S. Pat. No. 3,849,207 describes and claims a process for treating aluminum and other metals wherein the surface is treated with an alkaline, sodium formate solution and then coated with a clear resinous film to form a sepia-colored coating. The nature of the coating formed during treatment in the alkaline sodium formate solution is not described in the reference. However, it has been found that the aluminum surface underlying such a coating is readily susceptible to water stain or other oxidation in much the same manner as untreated aluminum because the coating is readily wet and penetrated by water or aqueous solutions.

A simple, inexpensive method, which temporarily prevents extensive oxidation of an aluminum surface by water or other media and which also prepares the surface for the application of a lubricant, has been needed for many years but has been heretofore unavailable.

It is against this background that the present invention was developed.

DESCRIPTION OF THE INVENTION

The invention generally relates to a simple method of coating an aluminum surface and particularly to the treatment of an aluminum surface to form a tenacious, hydrophobic and oleophilic coating which not only protects the underlying aluminum surface from significant oxidation but also facilitates the application of lubricant during subsequent fabrication of the aluminum workpiece. As used herein, aluminum refers to pure aluminum, commercially pure aluminum and aluminum alloys. Numbered aluminum alloy identifications herein refer to Aluminum Association alloy designations.

In accordance with the invention, an aluminum surface is treated under alkaline conditions with a long chain aliphatic carboxylic acid having one or more short secondary alkyl groups near the nonpolar end thereof. Also suitable are equivalent salts of such carboxylic acids or compounds which generate equivalent long chain aliphatic carboxylate anions under the alkaline conditions required by the invention. Generally, the secondary branched alkyl groups should be attached to one of the last three carbon atoms on the nonpolar end of the carboxylate compound.

The tenacious surface coating formed is both hydrophobic and highly oleophilic. Moreover, the coating is not significantly affected by short-term exposure to mineral acids, such as nitric acid, hydrochloric acid or sulfuric acid at room temperatures and is not removed by common polar solvents, such as acetone or ethyl alcohol. The coating formed is very difficult to analyze because under most circumstances, it appears to be a monomolecular layer on the order of 100 A thick. Coating formation is attributed to the carboxylic acid anion under alkaline conditions either reacting with a fresh aluminum surface to form a type of aluminum soap or at least strongly associating with the fresh aluminum surface.

The carboxylic acids or their equivalents which are suitable for use in the invention are the branched chain isomers of long chain fatty acids having secondary methyl, ethyl or propyl groups on or near the nonpolar end of the acid molecule or anion. The branched chain carboxylic acids generally have lower melting points than the corresponding unbranched isomer and therefore are more easily incorporated into hydrocarbon base oils. In the coating, the carboxylate group is apparently oriented perpendicular to the surface with the branched, nonpolar end of the anion exposed. The branched, nonpolar end of the carboxylic acid anion is more compatible with oily materials, such as oil-based lubricants, and the oil phase of oil-in-water lubricant emulsions than the straight chain isomers and therefore the coating of the invention is more readily wet by lubricants than coatings formed with straight chain carboxylic acids. The long chain carboxylate anion should have from 12–22 carbon atoms, preferably 14–20. Below 12 carbon atoms, the coatings are not sufficiently hydrophobic to be of any value in preventing the wetting of the coating and the penetration thereof by water or other aqueous solutions which leads to water stain. Compounds with more than 22 carbon atoms in the chain usually fail to react with the aluminum surface and do not become strongly associated with it. This latter feature is readily shown by removing the unreacted coating with polar solvents, such as acetone or ethyl alcohol.

Suitable long chain aliphatic carboxylic acids include the methyl, ethyl and propyl branched isomers of lauric acid, myristic acid, palmitic acid, stearic acid, oleic acid, ricinoleic acid, linoleic acid, arachidic acid and the like having 14–22 carbon atoms. Preferably, alkali metal salts of the above acids are used or are generated in solution, and, although the sodium and potassium salts are most desirable, lithium, cesium and ammonium salts are functional. Other compounds which generate the appropriate carboxylate anion under the alkaline treatment conditions of the invention can also be used. Large amounts of the branched chain carboxylic acid are not necessary, and amounts down to one part per million of the solution have been found functional. However, usually an amount far in excess of that soluble is added to the alkaline solution to avoid depletion of the carboxylate component over extended periods of operation. Operational levels normally can range from about 0.01 to 10 grams carboxylate compound per liter.

The aliphatic portion of the carboxylic acid or its equivalent can be saturated or unsaturated; however, unsaturated compounds tend to be less effective than saturated compounds. Substitutions on the aliphatic carbon chain, in addition to the short alkyl groups previously described, can be made, provided they do not prevent the carboxylate compound from forming the desired coating. Most commercially available branched chain isomers of fatty acids suitable for use in the process of the invention are complex mixtures of isomers, primarily of the methyl branched sereis. The various isomers in such complex mixture are mutually soluble and inseparable for all practical purposes. Commercially available acids include Emersol®871 and 875 which are isostearic acid sold by Emery Industries, Inc.

Several modes of coating formation have been developed in accordance with the invention, all of which require alkaline conditions. For example, the aluminum surface can be treated with an aqueous alkaline solution containing the branched chain fatty acid. Alternatively, the aluminum surface can be deformed or abraded in such a manner to disrupt the natural oxide coating and thereby expose the underlying aluminum surface to a branched chain carboxylic acid under alkaline conditions. In both cases, the natural oxide coating is apparently removed or disrupted and the underlying nacent aluminum is immediately oxidized. The newly formed oxide is more reactive than aged natural oxide and an aluminum surface having a newly formed oxide coating is herein referred to as a "fresh" aluminum surface.

Treatment times are usually longer than 0.1 second, preferably longer than one second. Excessively long treatment periods, e.g., 60 minutes, do not detrimentally affect the coating formed.

In one embodiment of the invention wherein the coating is formed by treating the aluminum surface with an aqueous alkaline solution containing the prescribed branch-chain fatty acids or their equivalents, the pH of the treating solution must be from about 8.0 to about 10.0, preferably about 9–10. At a pH much above 10, no coating occurs, only etching. The temperature at the interface between the metal and the bath should exceed 60° C and preferably should be from about 75° C to the boiling point of the solution. For optimum results, the temperature is maintained at about 85° C±5° C. Although generally it will be most convenient to treat the aluminum surface with a solution maintained at the prescribed temperatures, it is contemplated to treat an aluminum workpiece heated well above the prescribed temperature with a solution at less than the prescribed temperature to effect the required interface temperatures. No significant coating formation is found at interface temperatures much below 60° C when treating the surface with an aqueous alkaline solution.

The treatment solution may be rendered or maintained alkaline by the addition of appropriate saponifying agents, such as alkali metal hydroxide or ammonium hydroxide. Although ammonium salts and ammonium hydroxide can be employed in the alkaline treatment solutions, these compounds are not particularly desirable because at the required elevated interface temperatures, ammonia is driven from the solution rendering the maintenance of a suitably alkaline pH at the interface very difficult.

When the aluminum surface is first contacted by an aqueous alkaline solution of the invention, an initial, very short burst of effervescence occurs indicating that the aluminum substrate is being etched. The effervescence quickly subsides, however, and the desired hydrophobic coating forms, usually within 1–5 seconds. A heavy oxide layer can retard coating formation and apparently most, if not all, of the natural oxide coating must be etched away before any reaction or strong association can occur between the carboxylate anion and the fresh aluminum substrate. The etching which occurs initially in the process is believed to leave or generate a very thin reactive layer of oxide on the metal surface, and, in all likelihood, the carboxylate anion may be reacting with basic sites on the fresh aluminum surface to form a soap. Similar phenomena may be occurring when the natural oxide coating is disrupted during deformation such as rolling.

If desired, wetting agents, such as Emsorb®6903 (sold by Emery Industries, Inc.), Tween®85 (sold by ICI American, Inc.) and Ultrawet® (sold by Armour and Company) can be added to the aqueous alkaline solution in an amount up to 3% by weight to facilitate the wetting of the surface by the alkaline solution during treatment. However, wetting agents are not needed to make the formed coating highly oleophilic as described in copending application Ser. No. 610,966. Other components, such as emulsifiers and the like, can be added up to 3% by weight to render the fatty acid component miscible or at least emulsifiable with the aqueous solution. Mechanical dispersions can also be employed, for example, when the emulsification of the carboxylate generating component in the alkaline solution is difficult.

The coating of the invention can also be formed by deforming the aluminum surface in the presence of a branched chain carboxylic acid (or an equivalent carboxylate compound) under alkaline conditions. The natural oxide coating is apparently broken up by the deformation, thereby exposing a fresh aluminum surface, and this allows the isomeric carboxylic acid under alkaline conditions to react and/or strongly associate with the fresh aluminum substrate. The carboxylic acid can be most readily applied to the fresh surface by incorporating the acid into the metal-working lubricant. An alkaline material, such as sodium or potassium hydroxide, must usually be present in the lubricant to generate the necessary alkaline conditions. In water-based lubricant systems, the aqueous phase usually contains the alkaline material and the pH thereof lies within the range of 7.5 and 10. In nonaqueous lubricant systems, the alkaline material can be dissolved in a solvent which readily dissolves in or which is miscible with the nonaqueous lubricant carrier and then the solution is mixed with the nonaqueous carrier. Suitable solvents for the alkaline compounds include ethyl alcohol, methyl ethyl ketone, acetone and other common organic polar solvents. Without the addition of the alkaline material, the fatty acid isomers merely physically cover the aluminum surface and they can be readily removed by polar solvents, indicating that the desired tenacious coating has not been formed. Surface deformation can generate very high surface temperatures and because of this, the pH requirements can be lowered in comparison with surface treatment with an aqueous solution.

It is believed that when nonaqueous lubricants or other fluids are maintained on the surface during deformation, there is apparently a sufficient amount of moisture at the metal-fluid interface during deformation or abrasion to generate the necessary basic conditions in conjunction with the added alkaline material. Moreover, there is sufficient heat generated by the surface deformation to assure coating formation within a reasonable time.

The carboxylic acids (or their equivalents) of the invention are excellent lubricity agents and can be readily incorporated into the various lubricant compositions, including both oil-based and water-based lubricant systems. Most oil-based lubricant systems include a paraffinic or naphthenic hydrocarbon oil and intermixed therewith are various lubricity agents. The water-based lubricant systems are oil-in-water emulsion or dispersions where the oil phase comprises a similar base hydrocarbon oil, at least one lubricity agent and, if needed, one or more emulsifiers. The carboxylic acid of the invention can be used to replace in whole or in part the lubricity agents in existing commercial lubricants. For example, a mixture of butyl stearate and commercialgrade lauryl alcohol in a hydrocarbon base oil has been used as a lubricant for the cold rolling of aluminum sheet. The carboxylic acid of the invention, e.g., isostearic acid, can replace in whole or in part the butyl stearate, with the appropriate addition of an alkaline compound to the lubricant system by means of a miscible solvent as previously described.

The desired alkalinity level in nonaqueous lubricant systems can be determined by physically mixing 10 ml of the lubricant with 100 ml of distilled or deionized water and determining the pH of the aqueous phase which separates from the mixture. A pH of about 7.5–10 generally indicates that the desired alkalinity is present.

The surface coating which forms in the invention is neither readily wet nor penetrated by water or other nonalkaline aqueous solutions. The surface is highly oleophilic and is compatible with and readily wet by most, if not all, metal-working lubricants including water-based emulsions.

The hydrophobic, oleophilic coating formed by the process of the invention has an electrical resistance initially of about 10 microhms which remains relatively stable for at least 7 weeks. This indicates that essentially no oxidation of the underlying aluminum surface is occurring. These resistance levels are to be compared with a natural oxide coating which has an initial resistance of about 10 microhms and which can gradually increase to well over 1000 microhms in a matter of days. The stabilizing effect on resistance exhibited by the coating of the invention is a very advantageous feature. For example, in spot resistance welding aluminum, a very high or very low resistance is not desirable. Preferably, the resistance ranges from about 40–300 microhms. A resistance within the preferred range can be developed by first forming an oxide coating of controlled thickness and/or electrical resistance and then forming the hydrophobic surface of the invention on the freshly prepared oxide layer. The hydrophobic surface layer effectively prevents the further oxidation of the underlying aluminum substrate so that the oxide thickness and/or resistance is stabilized within the preferred range over extended periods.

The hydrophobic aluminum surfaces of the invention have many other unique and attractive features. For example, when such surfaces are subjected to elevated temperatures in an anodizing atmosphere, the hydrophobic coating is itself destroyed but a very thin and dense oxide coating is formed which minimizes further oxidation. Thus, during annealing or other high temperature thermal treatments, the aluminum surface remains free of discoloration and surface disfigurement. Similar effects are noted with commercial vacuum brazing sheet having a hydrophobic coating in accordance with the invention. After vacuum brazing with such treated sheet, the brazements are not discolored or otherwise disfigured due to the vacuum brazing process.

The coating of the invention can be readily removed by treatment with hot aqueous cleaning solutions (acid or alkaline) normally employed to clean aluminum surfaces prior to various surface treatments, such as anodizing, painting and the like.

The process of the invention utilizing an aqueous alkaline solution can be employed to treat aluminum surfaces which are oxidized or otherwise contaminated with oxidized products prior to fabrication. The etching which occurs in the process removes the contaminated oxide surface and the coating formed is readily compatible with and wet by metal-working lubricants. For example, the surface of aluminum alloy sheet used for making drawn and ironed can bodies is frequently contaminated with oxidation products which interfere with the drawing and ironing operations. By treating such sheet in accordance with the invention, the initial etching removes substantially all of the oxidized surface contaminants and the coating formed readily accepts and is wet by conventional draw and iron lubricant. Treatment times with heavy natural oxide coatings tend to be in the order of several minutes rather than a few seconds as when a relatively thin natural oxide-coated aluminum surface is treated. The ability of the lubricant to wet the entire metal surface is very important in cupping and draw and iron can body making operations. With out a uniform coat of lubricant, tears, surface defects and the like result.

The following examples are given to further illustrate the invention.

EXAMPLE I

An aqueous emulsion of 1% by weight isostearic acid (Emersol ®871) was prepared at a temperature of 80° C and the pH of the aqueous phase was adjusted to 9.5 by additions of NaOH. Panels of 5657 aluminum alloy were submerged in the aqueous emulsion for 30 seconds, rinsed with distilled water, then air-dried. The panels had a tenacious, hydrophobic and an oleophilic coating which was highly resistant to polar organic solvents.

EXAMPLE II

An aqueous bath containing 0.1% by weight of isostearic acid (Emersol ®871) was prepared at a temperature of 85° C and the pH of the aqueous phase was adjusted to 9.5 by additions of NaOH. Panels of 3004 aluminum alloys were submerged in the bath for 30 seconds, rinsed with distilled water and then air-dried. The panels had a tenacious, hydrophobic and oleophilic coating which was highly resistant to polar organic coatings.

EXAMPLE III

A 3004 aluminum alloy sheet was cold rolled on a small laboratory rolling mill with an alkaline oil-based lubricant consisting of 4% by weight isostearic acid (Emersol ®871), 3% by weight of a mixture C14, C16 and C18 alcohols (Alfol 1418) and the remainder a base hydrocarbon oil (Somentor 43). About 0.2 gram/liter of KOH was included with the alcohol mixture so that the lubricant exhibited a pH of 9.3 when mixed 1:1 with distilled water. The coating formed during rolling was hydrophobic, oleophilic and highly resistant to polar organic solvents.

The treated panels of the above examples exhibited a more highly oleophilic surface and the surfaces thereof were more readily wet with commercial lubricants than the panels which had been treated in the same manner but with straight chain carboxylic acids.

What is claimed is:

1. A method of preparing a hydrophobic and oleophilic protective coating on an aluminum workpiece consisting essentially of developing a fresh aluminum surface on said workpiece and then treating the fresh aluminum surface under alkaline conditions with a liquid selected from the group consisting of nonaqueous liquids and aqueous liquids with a pH less than 10, said liquids containing an effective amount of a branched chain aliphatic carboxylic acid or an equivalent carboxylate compound having from 12 to 22 carbon atoms.

2. The method of claim 1 wherein the natural oxide coating on the aluminum surface is mechanically removed or disrupted so as to expose a fresh aluminum surface and then the fresh aluminum surface is treated under alkaline conditions with the branched chain aliphatic carboxylic acid or an equivalent carboxylate compound.

3. The method of claim 2 wherein the aluminum surface is mechanically removed or disrupted by rolling.

4. The method of claim 2 wherein the aluminum surface is mechanically removed or disrupted by abrading.

5. The method of claim 1 wherein the branched aliphatic chain on the aliphatic carboxylic acid contains from 1–3 carbon atoms and is located at or near the nonpolar end of the carboxylic acid or an equivalent carboxylate compound.

6. The method of claim 1 wherein the carboxylic acid is isostearic acid.

7. The method of claim 1 wherein the compound which generates the alkaline conditions is selected from the group consisting of sodium and potassium hydroxide.

8. A method of forming a hydrophobic and oleophilic protective coating on an aluminum workpiece consisting essentially of developing a fresh aluminum surface on said workpiece and then treating the fresh aluminum surface with an aqueous alkaline solution at a pH less than 10 containing an effective amount of a branched chain aliphatic carboxylic acid or an equivalent carboxylic compound having from 12–22 carbon atoms.

9. The method of claim 8 wherein the pH of the aqueous solution is between about 7.5 and 10.

10. The method of claim 8 wherein the pH of the aqueous solution is between about 8.5 and 10.

11. The method of claim 8 wherein the temperature at the interface between the aluminum surface and the treating solution is greater than 60° C.

12. The method of claim 8 wherein the aluminum surface is treated with the aqueous alkaline solution for at least 0.1 second.

13. The method of claim 8 wherein the aqueous alkaline solution contains at least one part (by weight) per million of the carboxylic acid or an equivalent carboxylic compound.

14. The method of claim 8 wherein the aqueous alkaline solution contains from about 0.01 to 10 grams/liter of the carboxylic acid or an equivalent carboxylate compound.

15. The method of claim 8 wherein the branched aliphatic chain on the aliphatic carboxylic acid contains from 1–3 carbon atoms and is located at or near the nonpolar end of the carboxylic acid or an equivalent carboxylate compound.

16. The method of claim 8 wherein the temperature at the interface between the aluminum surface and treating solution is between about 75° C and the boiling point of the solution.

17. The method of claim 8 wherein the carboxylic acid is isostearic acid.

18. The method of claim 8 wherein the compound which generates the alkaline conditions is selected from the group consisting of sodium and potassium hydroxide.

19. The method of claim 8 wherein the aluminum surface is treated with the aqueous alkaline solution for at least one second.

* * * * *

UNITED STATES PATENT AND TRADEMARK OFFICE

CERTIFICATE OF CORRECTION

PATENT NO. : 4,101,346
DATED : July 18, 1978
INVENTOR(S) : Geoffrey A. Dorsey, Jr.

It is certified that error appears in the above-identified patent and that said Letters Patent are hereby corrected as shown below:

Column 3, line 36, "sereis" should be --series--

Column 8, line 18-19, "carboxylic" should be --carboxylate--

Column 8, line 32-33, "carboxylic" should be --carboxylate--

Signed and Sealed this

Sixth Day of March 1979

[SEAL]

*Attest:*

RUTH C. MASON
*Attesting Officer*

DONALD W. BANNER
*Commissioner of Patents and Trademarks*